United States Patent [19]

Baran, Jr.

[11] 4,406,580

[45] Sep. 27, 1983

[54] INSPECTION HOLE PLUG FOR GAS TURBINE ENGINE

[75] Inventor: Walter J. Baran, Jr., South Glastonbury, Conn.

[73] Assignee: United Technologies Corporation, Hartford, Conn.

[21] Appl. No.: 286,131

[22] Filed: Jul. 23, 1981

[51] Int. Cl.[3] ..... F01D 25/00

[52] U.S. Cl. ..... 415/118; 415/201

[58] Field of Search ..... 415/118, 201; 60/705, 60/39.32; 356/241

[56] References Cited

U.S. PATENT DOCUMENTS

| | | | |
|---|---|---|---|
| 841,254 | 1/1907 | Junggren | 415/118 |
| 2,832,195 | 4/1958 | Weissborn | 60/39.32 X |
| 3,007,312 | 11/1961 | Shutts | 60/39.821 |
| 3,362,160 | 1/1968 | Bourgeois | 415/201 X |
| 3,989,408 | 11/1976 | Jaegtnes | 415/118 X |
| 4,011,017 | 3/1977 | Feuerstein et al. | 415/118 X |

FOREIGN PATENT DOCUMENTS

| | | | |
|---|---|---|---|
| 1145491 | 3/1963 | Fed. Rep. of Germany | 415/118 |

*Primary Examiner*—Harvey C. Hornsby
*Assistant Examiner*—Christine A. Peterson
*Attorney, Agent, or Firm*—Norman Friedland

[57] ABSTRACT

A plug for boroscope access hole located in the turbine section viewing from the outside the internal parts of the engine by cooperating holes formed in concentric casings characterized as free floating and sealing the attendant opening in an axial and radial direction.

6 Claims, 1 Drawing Figure

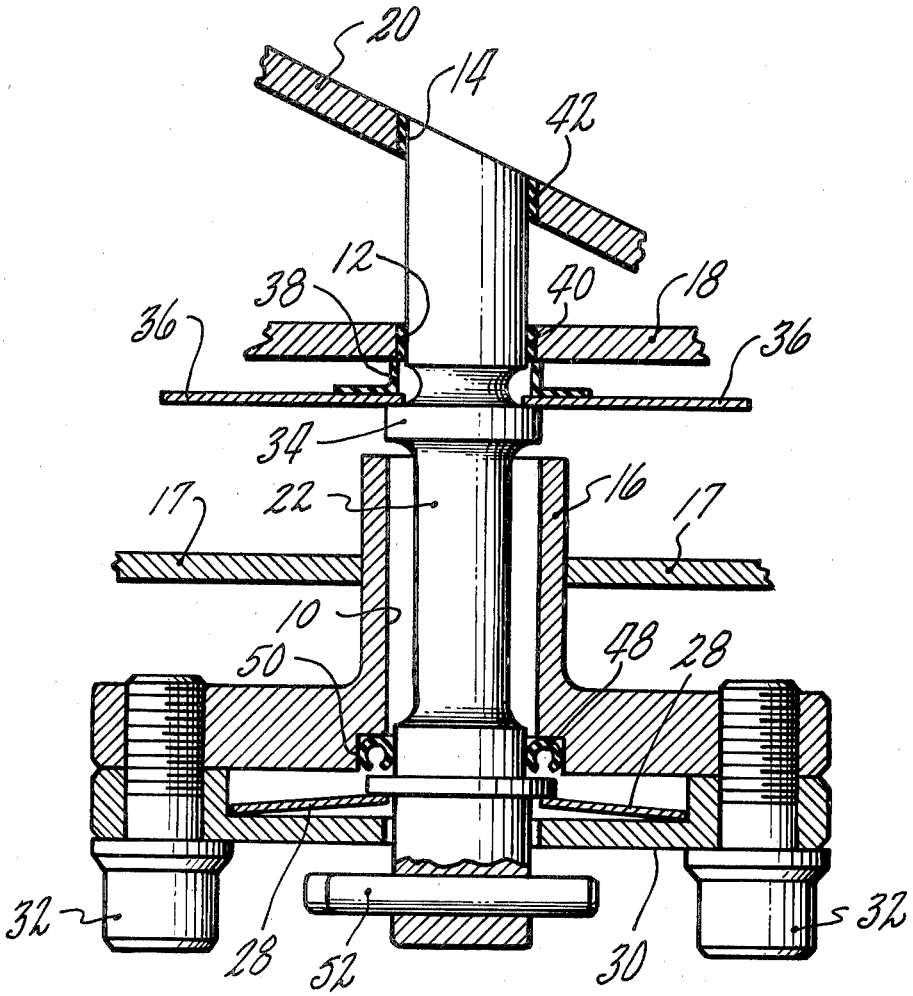
20
14
42
12
38
40
18
36
36
34
17
22
16
17
10
50
48
28
32
28
52
30
32

INSPECTION HOLE PLUG FOR GAS TURBINE ENGINE

DESCRIPTION

TECHNICAL FIELD

This invention relates to gas turbine engines and particularly to the boroscope access port located in the turbine section of the engine.

BACKGROUND ART

A problem that has been perplexing and long standing is the cracking of the material in close proximity to the boroscope access hole. Heretofore, the access hole was plugged by seating the plug on a boss formed at the access hole on the exterior of the engine.

I have found that I can obviate or at least minimize this problem by the free float mounting of the plug together with the judicious seating arrangement, which lessens the likelihood of fluid in the respective casings to migrate to the other casings. This invention contemplates spring loading the plug which compensates for dimensional tolerance in the axial stack-up as well as providing support for the plug which allows relative motion between the inner most casing and the outer casing.

DISCLOSURE OF INVENTION

An object of this invention is to provide for a gas turbine engine improved plug means for the boroscope access port. The plug is free-floating and retained in position by resilient means adapted to maintain the plug in radial and axial sealing position relative to the respective openings in the concentric cases through which the boroscope passes through.

Other features and advantages will be apparent from the specification and claims and from the accompanying drawings which illustrate an embodiment of the invention.

BRIEF DESCRIPTION OF DRAWINGS

The sole FIGURE is a partial view partly in elevation and partly in section illustrating this invention.

BEST MODE FOR CARRYING OUT THE INVENTION

As is shown in the sole FIGURE, the access port consisting of aligned holes 10, 12 and 14 in cylindrical depending member 16, intermediate casing 18, and inner casing 20, respectively, allows acceptance of the boroscope which is used in inspection of the turbine components. Cylindrical depending member 16 is joined to outer casing 17 by any suitable means, as welding, brazing and the like. Obviously, during engine operation the access port is sealed by plug 22 which forms the subject matter of this invention. Inasmuch as the access port passes through three different casings each containing fluid at different temperatures and pressures, the plug is in constant thermal stress. In addition, each casing grows relative to the other cases and causes distortions and relative movement. In accordance with this invention, the plug is allowed to float freely in the ports allowing movement of the cases relative to the plug without affecting the stress concentration. To this end, a conical spring 28 (Belville washer type) is mounted in retaining cap 30 and when cap 30 is bolted to boss 12 by the retaining bolts 32 (only two being shown) the spring is compressed to axially load the plug 22. An enlarged diameter section 34 intermediate the ends of plug 22 seats against a conventional cooling baffle 36 urging the axial seal 38 to seat against the outer surface of intermediate case 18. Radial seals 40 and 42 serve to prevent fluid from escaping from the casings 16 and 20 respectively.

C-seal 48 mounted in recess 50 surrounds and bears against plug 22 at the outer extremity in boss 12.

A cotter pin 52 may be mounted in a suitable opening in an external portion of the plug so that when cap 30 is removed, the plug and its cooperating members will be retained in a single unit.

It should be understood that the invention is not limited to the particular embodiments shown and described herein, but that various changes and modifications may be made without departing from the spirit and scope of this novel concept as defined by the following claims.

I claim:

1. A removable plug for sealing an access hole for accepting an instrument for viewing the components of the turbine section of a gas turbine engine formed in at least three concentric casings in which pressurized fluid of different temperature flow through said turbine section of said gas turbine engine comprising a cylindrical elongated body extending into said access hole and engaging said casings and extending externally of said engine and free floating in said access hole, a cap supported to the outer of said casings mounted in proximity to said cylindrical elongated body and defining retaining means, resilient means in said cap supported in said retaining means and bearing against said plug to load said plug in an axial direction and being allowed to realign itself relative to said casings upon said casings being distorted due to temperature and pressure variation to which said casings are being subjected.

2. A removable plug as in claim 1 including a baffle plate concentric to and spaced from one of said pair of casings, a land formed on said plug in proximity to said baffle plate and bearing against said baffle plate to urge it toward said one of said pair of casings, an axial seal supported to said baffle plate and being in sealing engagement with the outer surface of said one of said pair of casings, and the outer casing having a relatively constant cross-sectional area in proximity to said access hole.

3. A removable plug as in claim 2 including circular radial seals inserted in openings in said pair of casings for surrounding and bearing against a portion of said cylindrical elongated body for sealing the fluid within the respective casings.

4. A removable plug as defined in claim 3 including a cylindrically depending member supported to the outer casing of said engine having an axial base through which said cylindrical elongated body of said plug passes, a flange-like portion of said cylindrical depending member extending beyond said casing and accessible externally of said casing for supporting said cap, a portion of said elongated cylindrical body extending through an opening formed in said cap, pin means supported in said portion of said elongated cylindrical body for retaining said plug to said cap when said cap is removed from said flange-like portion.

5. A removable plug as in claim 4 wherein said resilient means is a conical spring.

6. A removable plug as in claim 5 including a recess formed in said flange-like portion adjacent said cylindrical elongated body, seal means in said recess bearing against a surface of said cylindrical elongated body.

* * * * *